US009429314B2

(12) United States Patent
Klarner et al.

(10) Patent No.: US 9,429,314 B2
(45) Date of Patent: Aug. 30, 2016

(54) TUBE SUPPORT SYSTEM FOR NUCLEAR STEAM GENERATORS

(71) Applicant: Babcock & Wilcox Canada Ltd., Cambridge (CA)

(72) Inventors: Richard G Klarner, Georgetown (CA); Robert S Horvath, Drumbo (CA); Ghasem V Asadi, Cambridge (CA); Paul W Shipp, Toronto (CA)

(73) Assignee: BWXT Canada Ltd., Cambridge, Ontario (CA)

( * ) Notice: Subject to any disclaimer, the term of this patent is extended or adjusted under 35 U.S.C. 154(b) by 524 days.

(21) Appl. No.: 14/031,123

(22) Filed: Sep. 19, 2013

(65) Prior Publication Data

US 2014/0060787 A1 Mar. 6, 2014

Related U.S. Application Data

(62) Division of application No. 12/180,478, filed on Jul. 25, 2008, now Pat. No. 8,572,847.

(51) Int. Cl.
*F22B 37/24* (2006.01)
*F28F 9/007* (2006.01)
(Continued)

(52) U.S. Cl.
CPC ..... *F22B 37/205* (2013.01); *F22B 37/002* (2013.01); *F22B 37/206* (2013.01);
(Continued)

(58) Field of Classification Search
CPC .... F22B 37/205; F22B 37/66; F22B 37/206; F22B 37/002; F28F 9/00; F28F 9/0131; F28F 9/22; F28F 2265/26; F28F 2009/224; F28B 7/1607; Y10T 29/4935; Y10T 29/49373
See application file for complete search history.

(56) References Cited

U.S. PATENT DOCUMENTS 1,772,806 A * 8/1930 Grace ..... 165/162
2,876,975 A 10/1957 Short
(Continued)

FOREIGN PATENT DOCUMENTS

GB 2178146 2/1987
JP 62-022903 1/1987
(Continued)

OTHER PUBLICATIONS

Office Action for Canadian Patent Application No. 2673885, dated May 6, 2015.
(Continued)

*Primary Examiner* — Alexander P Taousakis
(74) *Attorney, Agent, or Firm* — Nelson Mullins Riley & Scarborough, LLP

(57) ABSTRACT

Apparatus for a steam generator that employs tube support plates within a shroud that is in turn disposed within a shell. The tube support plates are made of a material having a coefficient of thermal expansion lower than that of the shroud. The tube support plates are aligned during fabrication, with minimal clearances between components. Using a tube support displacement system, a controlled misalignment is then imposed on one or more tube support plates, as the steam generator heats up. The tube support plate displacement system has only one part, a push rod, which is internal to the steam generator shroud, thereby minimizing the potential of loose parts. The tube support plate displacement system can be used to provide controlled misalignments on one or more tube support plates, in the same or varying amounts and directions, and with one or more apparatus for each individual tube support plate.

14 Claims, 5 Drawing Sheets

(51) Int. Cl.

| | |
|---|---|
| ***F22B 37/20*** | (2006.01) |
| ***F22B 37/00*** | (2006.01) |
| ***F28D 7/16*** | (2006.01) |
| ***F28F 9/00*** | (2006.01) |
| ***F28F 9/013*** | (2006.01) |
| ***F28F 9/22*** | (2006.01) |
| ***F22B 37/66*** | (2006.01) |

(52) U.S. Cl.

CPC ..... *F22B 37/66* (2013.01); *F28D 7/1607* (2013.01); *F28F 9/00* (2013.01); *F28F 9/0131* (2013.01); *F28F 9/22* (2013.01); *F28F 2009/224* (2013.01); *F28F 2265/26* (2013.01); *Y10T 29/4935* (2015.01); *Y10T 29/49373* (2015.01)

(56) References Cited

U.S. PATENT DOCUMENTS

| | | | | |
|---|---|---|---|---|
| 4,204,305 | A | 5/1980 | Norton | |
| 4,336,614 | A | 6/1982 | Mitchell et al. | |
| 4,503,903 | A * | 3/1985 | Kramer | 165/76 |
| 4,690,206 | A | 9/1987 | Bein | |
| 4,768,582 | A * | 9/1988 | Wepfer | 165/82 |
| 5,447,191 | A * | 9/1995 | Boula | 165/69 |
| 5,492,170 | A * | 2/1996 | Gil | 165/162 |
| 5,497,827 | A * | 3/1996 | Cornic | 165/162 |
| 5,514,250 | A * | 5/1996 | Boula et al. | 165/69 |
| 6,130,927 | A | 10/2000 | Kang et al. | |
| 6,275,557 | B2 | 8/2001 | Nylund et al. | |
| 6,636,578 | B1 | 10/2003 | Clark | |
| 6,636,580 | B2 | 10/2003 | Murakami et al. | |
| 6,819,733 | B2 | 11/2004 | Broders et al. | |
| 6,865,242 | B2 | 3/2005 | Barbe et al. | |
| 6,914,955 | B2 | 7/2005 | Klarner | |
| 7,085,340 | B2 | 8/2006 | Goldenfield et al. | |
| 7,257,185 | B1 | 8/2007 | Yamada et al. | |
| 7,453,972 | B2 | 11/2008 | Hellandbrand, Jr. et al. | |
| 7,561,654 | B2 | 7/2009 | Makovicka et al. | |
| 7,668,280 | B2 | 2/2010 | Hellandbrand, Jr. et al. | |
| 7,668,284 | B2 | 2/2010 | Sparrow et al. | |
| 8,549,748 | B2 | 10/2013 | Klarner et al. | |
| 2009/0056924 | A1 * | 3/2009 | Inatomi et al. | 165/166 |
| 2010/0018689 | A1 | 1/2010 | Klarner et al. | |

FOREIGN PATENT DOCUMENTS

| | | | |
|---|---|---|---|
| JP | 2003-014391 | A | 1/2003 |
| JP | 5319438 | | 10/2013 |

OTHER PUBLICATIONS

Written Opinion for French Patent Application No. 0903634, dated May 7, 2014.

Office Action for Japanese Patent Application No. 2009-174176, dated Sep. 24, 2013.

The Babcock & Wilcox Company, Steam/its generation and use, 41st ed., Ch. 48, "Nuclear Steam Generators," 2005, U.S.A.

Japanese Office Action dated Mar. 19, 2013 for JP Patent Application No. 2009-174299.

Korean Office Action dated Mar. 18, 2015 for Korean Patent Application No. 10-2009-0067259.

* cited by examiner

TUBE SUPPORT SYSTEM FOR NUCLEAR STEAM GENERATORS

CROSS-REFERENCE TO RELATED APPLICATION

This application is a divisional of U.S. application Ser. No. 12/180,478, filed on Jul. 25, 2008, and now U.S. Pat. No. 8,572,847 issued Nov. 5, 2013, which is fully incorporated by reference herein.

FIELD AND BACKGROUND OF INVENTION

The present invention relates generally to nuclear steam generators, and in particular to a new and useful tube support system and method for use in nuclear steam generators which employ tube support plates to retain the tube array spacing within the steam generator.

The pressurized steam generators, or heat exchangers, associated with nuclear power stations transfer the reactor-produced heat from the primary coolant to the secondary coolant, which in turn drives the plant turbines. These steam generators may be as long as 75 feet and have an outside diameter of about 12 feet. Within one of these steam generators, straight tubes, through which the primary coolant flows, may be ⅝ inch in outside diameter, but have an effective length of as long as 52 feet between the tube-end mountings and the opposing faces of the tube sheets. Typically, there may be a bundle of more than 15,000 tubes in one of these heat exchangers. It is clear that there is a need to provide structural support for these tubes, such as a tube support plate, in the span between the tube sheets to ensure tube separation, adequate rigidity, and the like.

U.S. Pat. No. 4,503,903 describes apparatus and a method for providing radial support of a tube support plate within a heat exchanger, such as a U-tube steam generator having an inner shell and an outer shell. The apparatus is rigidly attached to the inner shell, and is used to centrally locate the tube support plate within the inner shell.

U.S. Pat. No. 5,497,827 describes apparatus and method for radially holding a tube support within a U-tube steam generator. Abutments radially separate an inner bundle envelope, or inner shell, from an outer pressure envelope. Each abutment is fixed to the inner bundle envelope by welding, and contacts the inner face of the pressure envelope. The abutments maintain the different coaxial envelopes of the steam generator and the assembly of the bundle by spacer plates in the radial directions. This is done to avoid relative displacements and shocks between the envelopes and the bundle in the case of external stresses, such as those accompanying an earthquake. In one variant, elastic pressure used to make contact with a spacer plate is obtained by a spiral spring. The spring is located internal to the pressure envelope.

U.S. Pat. No. 4,204,305 describes a nuclear steam generator commonly referred to as a Once Through Steam Generator (OTSG), the text of which is hereby incorporated by reference as though fully set forth herein. An OTSG contains a tube bundle consisting of straight tubes. The tubes are laterally supported at several points along their lengths by tube support plates (TSPs). The tubes pass through TSP holes having three bights or flow passages, and also having three tube contact surfaces for the purpose of laterally supporting the tubes. It is generally recognized that after a heat exchanger is assembled, the tubes will contact one or two of the inwardly protruding lands of the TSP holes. This contact provides lateral support to the tube bundle to sustain lateral forces such as seismic loads, as well as provides support to mitigate tube vibration during normal operation.

U.S. Pat. No. 6,914,955 B2 describes a tube support plate suitable for use in the aforementioned OTSG.

For a general description of the characteristics of nuclear steam generators, the reader is referred to Chapter 48 of *Steam/Its Generation and Use,* 41st Edition, The Babcock & Wilcox Company, Barberton, Ohio, U.S.A., © 2005, the text of which is hereby incorporated by reference as though fully set forth herein.

SUMMARY OF INVENTION

The present invention is drawn to an improved method and apparatus for supporting tubes in a steam generator.

According to the invention, there is provided a tube bundle support system and method which advantageously permits tube support plates to be installed in an aligned configuration that is compatible with normal fabrication processes. A controlled misalignment is then imposed on one or more tube support plates as the steam generator heats up, i.e. in the hot condition. The tube support plates are made from a material having a lower coefficient of thermal expansion than the shroud that surrounds the tubes. As a result, radial clearances open adjacent to the tube support plate as the steam generator heats up. These radial clearances provide space for lateral shifting or displacement of the individual tube support plates by an associated tube support plate displacement system.

Each tube support displacement system advantageously has only a single part located inside the steam generator shell, thereby minimizing the potential of loose parts. The remaining parts are located outside of the shell, and are readily accessible for inspection, adjustment or repair.

The method and apparatus can be readily retrofit to existing steam generators, since few internal alterations are required. Conversely, the invention can be easily removed, restoring the steam generator to its original condition.

The normal load paths used for the transmission of seismic loads between tubes, supports, shroud and shell are advantageously unaltered.

Accordingly, one aspect of the invention is drawn to a method of assembling and operating a steam generator having a plurality of tubes in a spaced parallel relation in which a fluid flows in and the tubes transfer heat with a fluid flowing over the tubes, and also having a plurality of tube support plates disposed transverse to the tubes. The method of assembling the steam generator includes the steps of 1) aligning the tube support plates, 2) inserting the tubes through the aligned tube support plates and, 3) while heating up the steam generator, displacing at least one support plate out of alignment in a lateral direction transverse to the tubes, thereby increasing tube support effectiveness. The method may include displacing only every other support plate. The method may also include displacing adjacent support plates in the same lateral direction transverse to the tubes.

Another aspect of the invention is drawn to a tube support system for use in a heat exchanger having a plurality of tubes in spaced parallel relation for flow of fluid there through and the tubes transfer heat with a fluid flowing there over, and also having a cylindrical shroud that is disposed within a cylindrical pressure shell and surrounds the tubes. The tube support system includes a tube support plate disposed transverse to the tubes that is made of a material having a lower coefficient of thermal expansion than the shroud. The tube support system also includes means for displacing the tube support plate in a lateral direction transverse to the tubes, which may be attached to an outer surface of the shell. The means for displacing the tube support plate may include a push rod connected to a spring which pushes the push rod into contact with an edge of the tube support plate, thereby displacing the tube support plate. The push rod may be the only component of the tube support system located within the shroud.

Yet another aspect of the invention is drawn to a tube support displacement system for use in a heat exchanger having a plurality of tubes in spaced parallel relation for flow of fluid there through and the tubes transfer heat with a fluid flowing there over, the heat exchanger further having tube support plates arranged transverse to the tubes and a cylindrical shroud, the shroud disposed within a cylindrical pressure shell and surrounding the tubes. The tube support displacement system includes a push rod having a first end for contacting a tube support plate and a second end opposite the first end in contact with a push rod piston. A helical spring, which may be preloaded, contacts the push rod piston thereby applying a lateral displacement force to the push rod in a direction transverse to the tubes. The helical spring and push rod piston are contained within a pressure chamber that is attached to the external surface of the shell. The tube support displacement system may include means, external to the shell, for adjusting the force applied to the push rod by the helical spring. The length or material of the push rod may be pre-selected to limit the maximum lateral displacement of the push rod. The push rod is the only component of the tube support displacement system located within the shroud.

The tube support plate displacement system can be used to provide controlled misalignments on one or more tube support plates, in the same or varying amounts and directions, and with one or more apparatus being provided for any individual tube support plate.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numbers are used to refer to the same or functionally similar elements.

DESCRIPTION OF THE PREFERRED EMBODIMENTS

Figure 1:
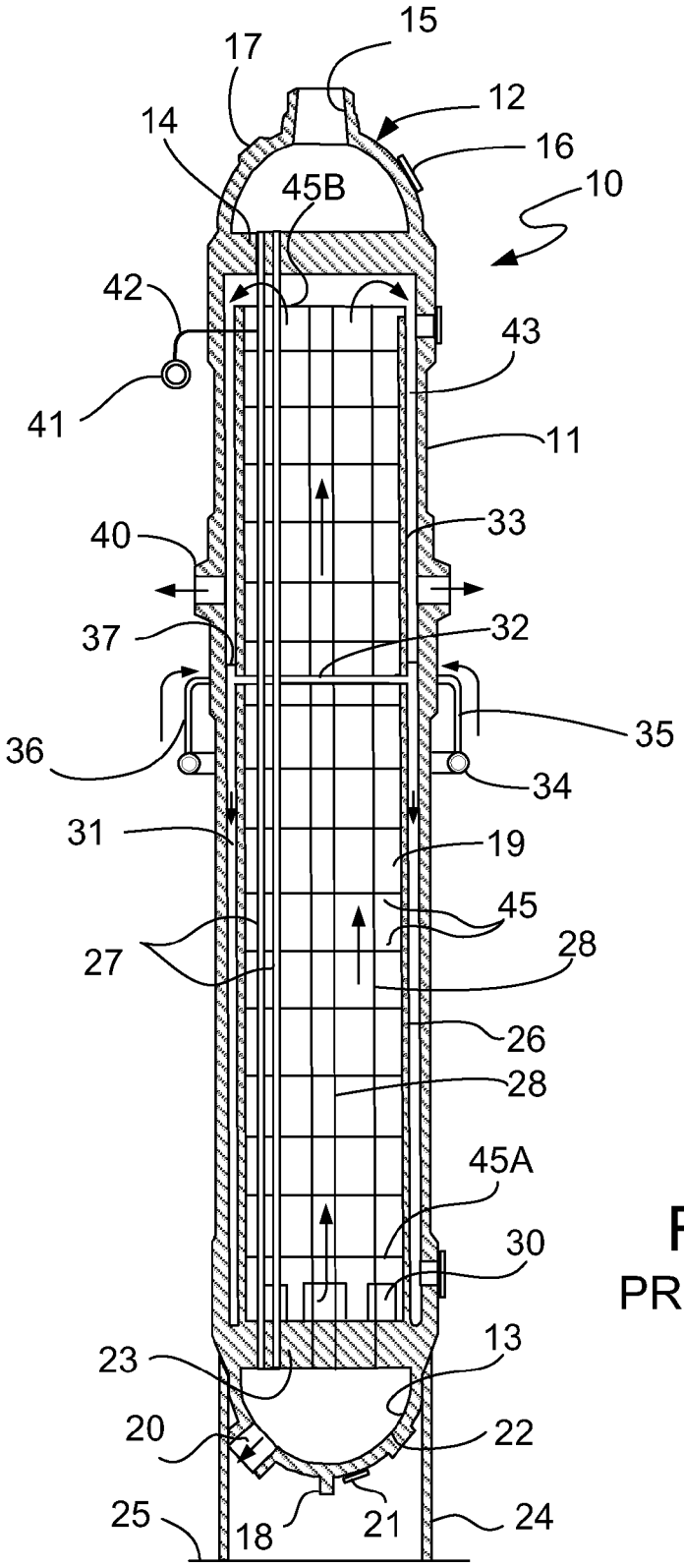
FIG. 1 PRIOR ART
FIG. 1 is a sectional side view of a once-through steam generator whereon the principles of the invention may be practiced.

FIG. 1 depicts a once-through steam generator, or OTSG 10 comprising a vertically elongated, cylindrical pressure vessel or shell 11 closed at its opposite ends by an upper head 12 and a lower head 13.

The upper head includes an upper tube sheet 14, a primary coolant inlet 15, a manway 16 and a handhole 17. The manway 16 and the handhole 17 are used for inspection and repair during times when the steam generator 10 is not in operation. The lower head 13 includes drain 18, a coolant outlet 20, a handhole 21, a manway 22 and a lower tube sheet 23.

The steam generator 10 is supported on a conical or cylindrical skirt 24 which engages the outer surface of the lower head 13 in order to support the steam generator 10 above structural flooring 25.

The overall length of a typical steam generator of the sort under consideration is about 75 feet between the flooring 25 and the upper extreme end of the primary coolant inlet 15. The overall diameter of the unit 10 moreover, is in excess of 12 feet.

Within the shell 11, a lower cylindrical tube shroud, wrapper or baffle 26 encloses a bundle of heat exchanger tubes 27, a portion of which is illustrated in FIG. 1. In a steam generator of the type under consideration moreover, the number of tubes enclosed within the shroud 26 is in excess of 15,000, each of the tubes having an outside diameter of ⅝ inch. It has been found that Alloy 690 is a preferred tube material for use in steam generators of the type described. The individual tubes 27 in the tube bundle each are anchored in respective holes formed in the upper and lower tube sheets 14 and 23 through belling, expanding or seal welding the tube ends within the tube sheets.

The lower shroud 26 is aligned within the shell 11 by means of shroud alignment pins. The lower shroud 26 is secured by bolts to the lower tube sheet 23 or by welding to lugs projecting from the lower end of the shell 11. The lower edge of the shroud 26 has a group of rectangular water ports 30 or, alternatively, a single full circumferential opening (not shown) to accommodate the inlet feedwater flow to the riser chamber 19. The upper end of the shroud 26 also establishes fluid communication between the riser chamber 19 within the shroud 26 and annular downcomer space 31 that is formed between the outer surface of the lower shroud 26 and the inner surface of the cylindrical shell 11 through a gap or steam bleed port 32.

A support rod system 28 is secured at the uppermost support plate 45B, and consists of threaded segments spanning between the lower tube sheet 23 and the lowest support plate 45A and thereafter between all support plates 45 up to the uppermost support plate 45B.

A hollow, toroid shaped secondary coolant feedwater inlet header 34 circumscribes the outer surface of the shell 11. The header 34 is in fluid communication with the annular downcomer space 31 through an array of radially disposed feedwater inlet nozzles 35. As shown by the direction of the FIG. 1 arrows, feedwater flows from the header 34 into the steam generator unit 10 byway of the nozzles 35 and 36. The feedwater is discharged from the nozzles downwardly through the annular downcomer 31 end through the water ports 30 into the riser chamber 19. Within the riser chamber 19, the secondary coolant feedwater flows upwardly within the shroud 26 in a direction that is counter to the downward flow of the primary coolant within the tubes 27. An annular plate 37, welded between the inner surface of the shell 11 and the outer surface of the bottom edge of an upper cylindrical shroud, baffle or wrapper 33 insures that feedwater entering the downcomer 31 will flow downwardly toward the water ports 30 in the direction indicated by the arrows. The secondary fluid absorbs heat from the primary fluid through the tubes 27 in the tube bundle and rises to steam within the chamber 19 that is defined by the shrouds 26 and 33.

The upper shroud 33, also aligned with the shell 11 by means of alignment pins (not shown in FIG. 1), is fixed in an appropriate position because it is welded to the shell 11 through the plate 37, immediately below steam outlet nozzles 40. The upper shroud 33, furthermore, enshrouds about one third of the tubes 27 of the bundle.

An auxiliary feedwater header 41 is in fluid communication with the upper portion of the tube bundle through one or more nozzles 42 that penetrate the shell 11 and the upper shroud 33. This auxiliary feedwater system is used, for example, to fill the steam generator 10 in the unlikely event that there is an interruption in the feedwater flow from the header 34. As mentioned above, the feedwater, or secondary coolant that flows upwardly along the tubes 27 in the direction shown by the arrows rises into steam. In the illustrative embodiment, moreover, this steam is superheated before it reaches the top edge of the upper shroud 33. This superheated steam flows in the direction shown by the arrow, over the top of the shroud 33 and downwardly through an annular outlet passageway 43 that is formed between the outer surface of the upper cylindrical shroud 33 and the inner surface of the shell 11. The steam in the passageway 43 leaves the steam generator 10 through steam outlet nozzles 40 which are in communication with the passageway 43. In this foregoing manner, the secondary coolant is raised from the feed water inlet temperature through to a superheated steam temperature at the outlet nozzles 40. The annular plate 37 prevents the steam from mixing with the incoming feedwater in the downcomer 31. The primary coolant, in giving up this heat to the secondary coolant, flows from a nuclear reactor (not shown) to the primary coolant inlet 15 in the upper head 12, through individual tubes 27 in the heat exchanger tube bundle, into the lower head 13 and is discharged through the outlet 20 to complete a loop back to the nuclear reactor which generates the heat from which useful work is ultimately extracted.

To facilitate fabrication, and specifically the insertion of tubes 27 during the fabrication process, the tube support plates 45 are generally aligned with each other, and also with the upper and lower tube sheets. The alignment of the tube support plates 45 is maintained by tube support plate alignment blocks 48 (see FIG. 2) situated around the perimeter of the tube support plates between the tube support plates and the inner surface of the shroud or baffle 26, 33. The tube support plate alignment blocks 48 are attached to the shroud 26, 33 or a tube support plate 45, but not to both, and fill most, or all, of the available clearance between the tube support plates 45 and shroud 26, 33 at discrete locations around the tube support plate perimeter. The shroud, which is generally a large continuous cylinder, is laterally supported within the OTSG shell 11 by shroud alignment pins 49 (see FIG. 2). This support arrangement provides a lateral load path from the tubes 27, through the tube support plates 45, to the shroud 26, 33, which is supported by the shell 11.

Referring now to FIGS. 2-5, the subject invention provides a tube bundle support system 100 and method for precisely aligning tube support plates 45 during fabrication, with minimal clearances between components, and then imposing a controlled misalignment as the steam generator heats up. Tube support plates 45 are advantageously installed in an aligned configuration that is compatible with normal fabrication processes. Displacement to produce misalignment is produced, only when the heat exchanger is heated. Displacement to misalign tube support plates 45 in the hot condition can advantageously mitigate tube vibration due to either cross flow or axial flow excitation mechanisms.

Misalignment between the different elevations of tube support plates 45 is partially accomplished during heat up by making the tube support plates 45 from a material having a lower coefficient of thermal expansion than the shroud 26, 33. Radial clearances 165, between tube support plates 45 and the shroud 26, 33, open at the positions of the tube support plate alignment blocks 48 as the steam generator heats up. These radial clearances provide space to facilitate lateral shifting or displacement of the individual tube support plates 45.

As described in greater detail below, lateral shifting or displacement is achieved by means of a tube support plate displacement system 150 having preloaded helical springs 152. Helical springs 152 push on the sides of respective tube support plates 45 by means of push rods 154. The difference in thermal expansion between the shroud 11, which is preferably made of carbon steel, and tube support plates 45, which are preferably made of 410S stainless steel, provides enough operational clearance to allow for effective lateral displacement of tube support plate 45, thereby mitigating flow induced vibration of tubes 27. Radial clearances 165 may be reduced to zero due to the push rod force.

Tube support plate alignment blocks 48 may be installed with an initial clearance to facilitate tube support plate motion in the hot condition.

Figure 5:
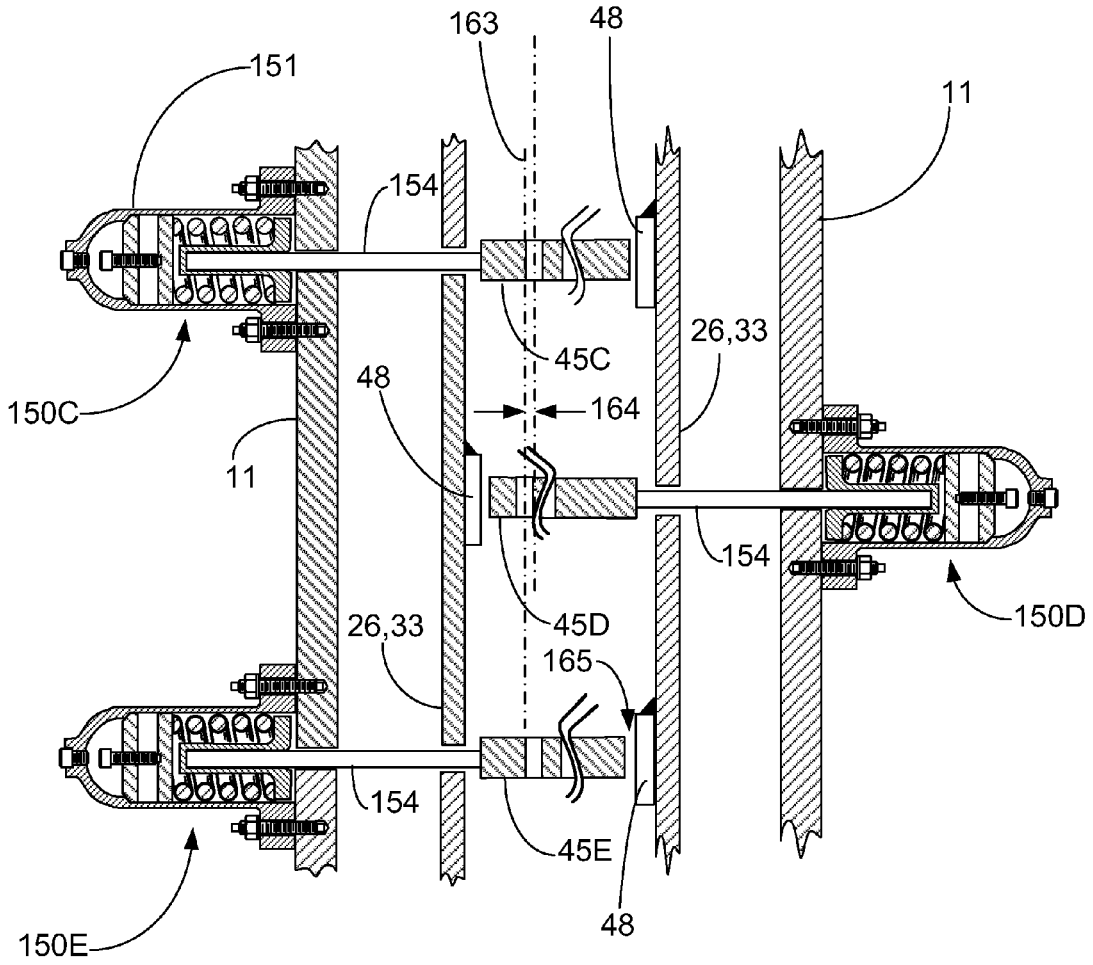
FIG. 5 is a sectional side view of a tube support plate arrangement incorporating a plurality of tube support plate displacement systems according to the present invention.

As shown in FIG. 5, by alternating the pushing direction for consecutive tube support plates at different elevations, e.g. 45C, 45D, and 45E, the desired tube support plate misalignment and the loading of tubes 27 within tube support plate holes can be achieved.

It may not be necessary to laterally misalign all tube support plate elevations. It may, for example, be acceptable to shift every other plate in the same direction, while restraining the remaining plates in their neutral positions to achieve the desired misalignment. Also, there may be more than one tube support plate displacement system 150 per tube support plate elevation. The tube support displacement system 150 can thus be used to variably displace the plurality of tube support plates, in one or more of a plurality of different directions, to provide controlled misalignments on one or more tube support plates, in the same or varying amounts and directions, and with one or more apparatus being provided for any individual tube support plate.

Figure 4:
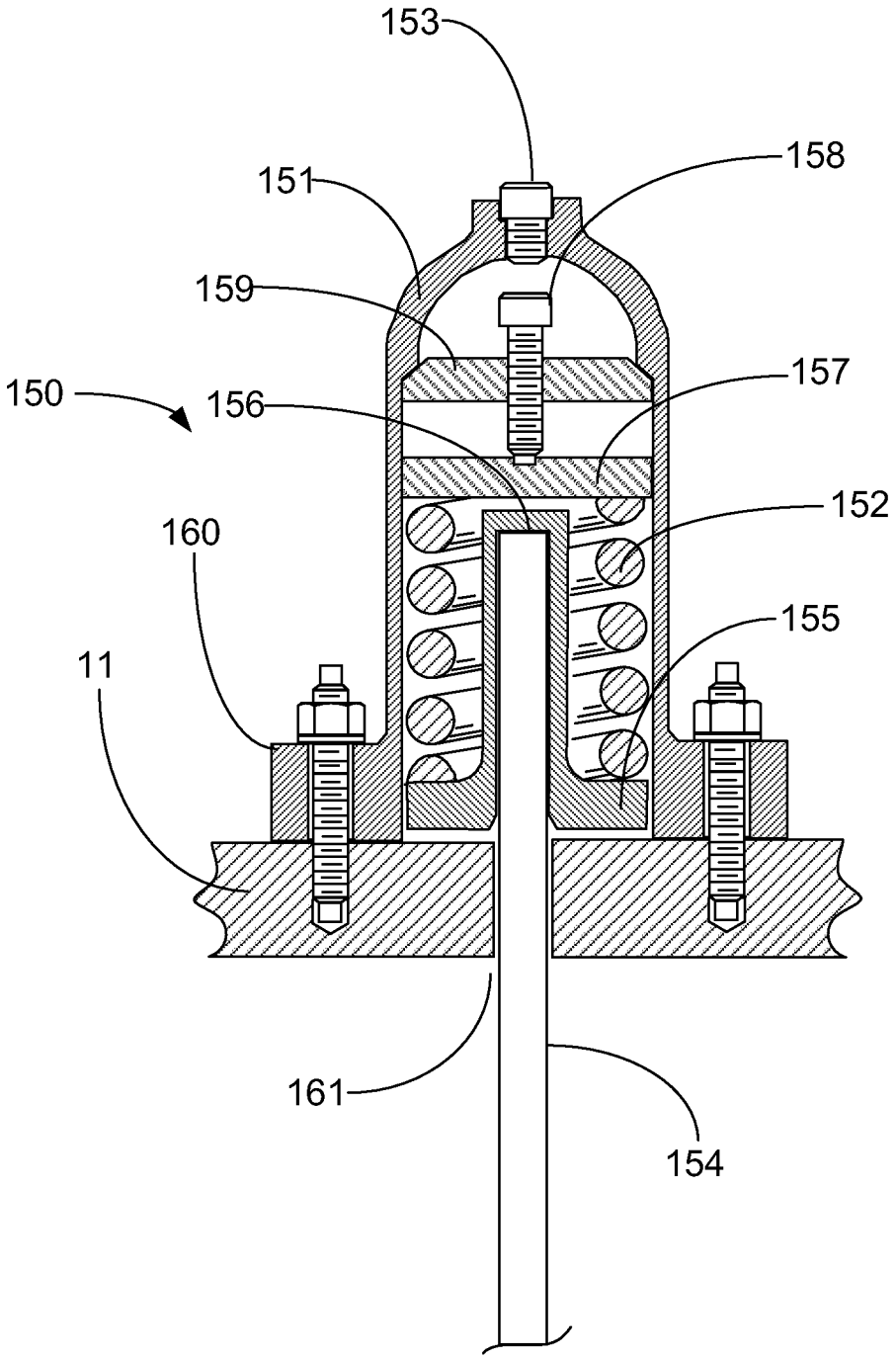
FIG. 4 is a sectional side view, taken along line 4-4 of FIG. 2, of a tube support plate displacement system according to the present invention.

As shown in FIG. 4, a tube support plate displacement system 150 is used to impose lateral displacements of tube support plates 45. A compressed helical spring 152 pushes on the outer end 156 of a push rod 154. Push rod 154 passes through holes 161, 166 in the shell 11 and shroud 26, 33 respectively, and contacts the outer edge of tube support plate 45.

Figure 2:
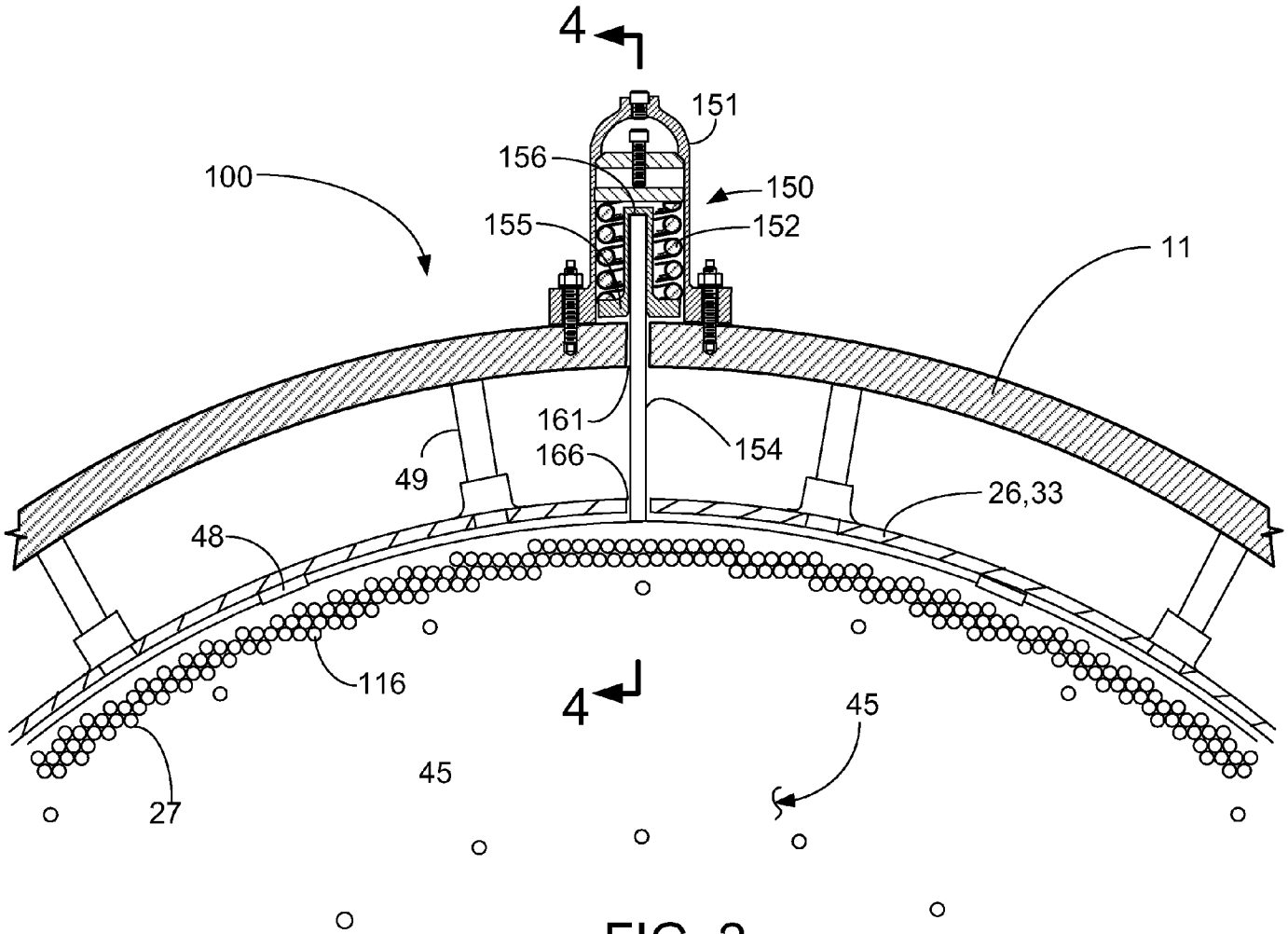
FIG. 2 is a sectional top view of a tube bundle support system installed in its operating environment according to the present invention.
Figure 3:
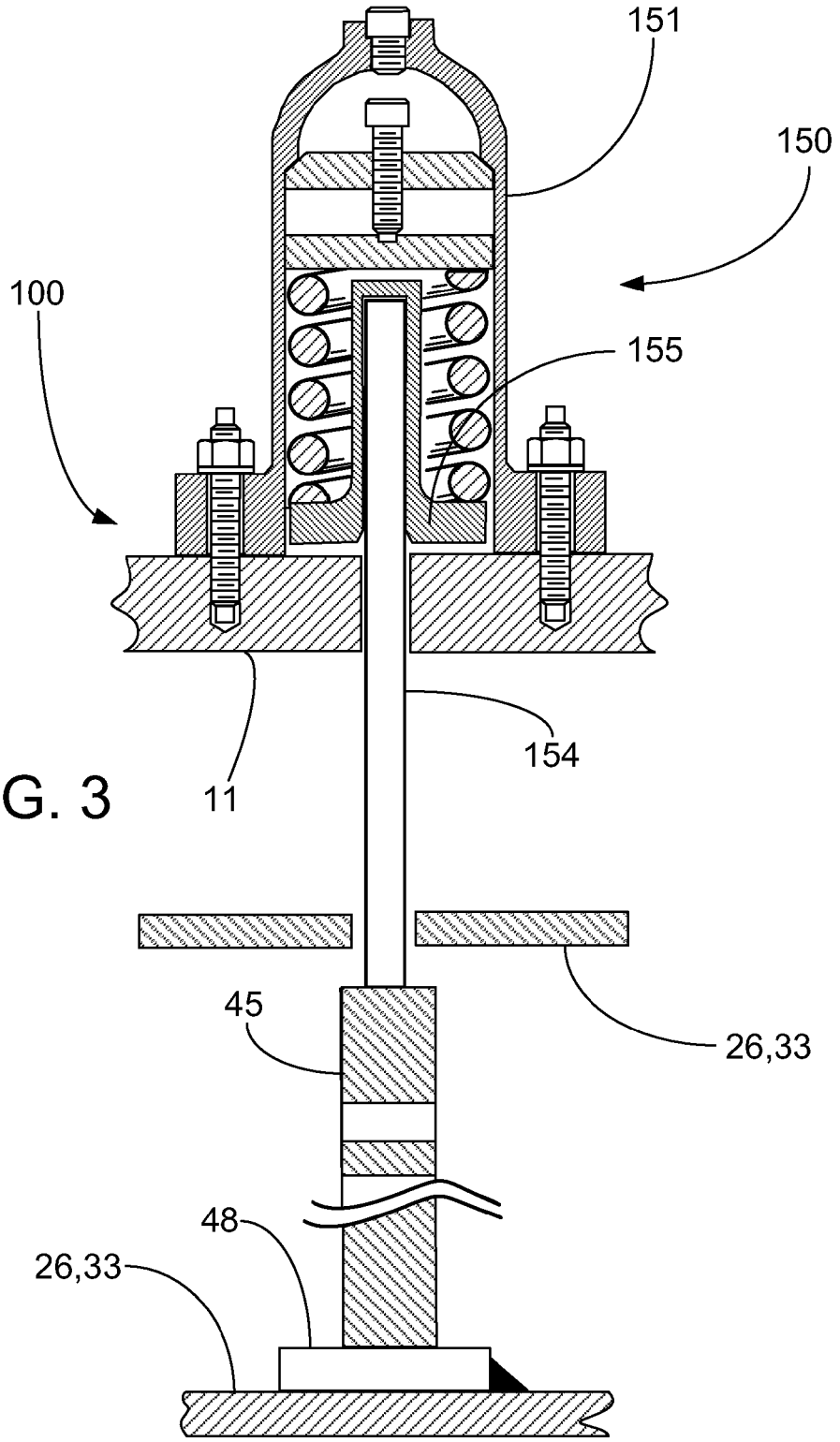
FIG. 3 is a sectional side view of a tube bundle support system according to the present invention.

The orientation of the push rod 154, in relation to the tube support plate 45, is illustrated in FIGS. 2 and 3. FIG. 3 shows the push rod 154 in contact with the tube support plate 45 in the nominal, as-built cold condition. In the cold condition, the tube support plate 45 is in contact with tube support plate alignment blocks 48 within the shroud 26, 33. The shroud 26, 33 is structurally held within the shell 11 by shroud alignment pins 49. In the cold condition, the lateral position of the tube support plate 45 is controlled by tube support plate alignment blocks 48, located intermittently around the perimeter of the tube support plate 45. As illustrated in FIG. 3, the force in the push rod 154, during as-built cold conditions, is reacted by the tube support plate alignment block(s) 48 on the opposite side of the tube support plate 45 without inducing a shift of the tube support plate 45.

When the shell/shroud/tube support plate assembly heats up, the higher coefficient of thermal expansion of the shell 11 and shroud 26, 33 material relative to the material of tube support plate 45 will cause a dilation of the shroud 26, 33 relative to the tube support plate 45. As shown in FIG. 5, in this hot condition, the push rod 154 will cause a lateral displacement or offset 164 of the tube support plate 45 relative to the initially centered position 163 within the shroud 26, 33. The compressive force in the push rod 154 will either be reacted by contact with tubes 27, or by contact with both tubes 27 and tube support plate alignment block(s) 48 on the opposite side of the tube support plate 45. In either case, tube contact forces are achieved thereby, providing the desired effect of increased tube support effectiveness.

Referring now to FIG. 4, control of the tube-to-support contact forces in the hot condition is achieved by controlling the initial cold condition preload in the compressed helical spring 152. The load in the compressed helical spring 152 is adjustable through an access plug 153 in the end of the pressure chamber 151.

In the cold shutdown condition, the access plug 153 can be removed, and by turning the spring preloading screw 158, the compression piston 157 is pushed towards the helical spring 152, thereby compressing it. The compressed helical spring 152 pushes against the push rod piston 155, which loads the push rod 154 with the desired force.

Additionally, the contact forces between tubes 27 and tube support plates 45 may be controlled by limiting the lateral displacement, or stroke, of the push rod 154. This maximum stroke distance can be controlled by either selecting a material for the tube support plate 45 with a desired coefficient of thermal expansion, such that the stroke is limited by the maximum radial clearance in the hot condition between the tube support plate 45 and the tube support plate alignment blocks 48, or, alternatively, by adjusting the length of the push rod 154 such that the initial distance between the push rod piston 155 and the shell 11 is controlled, thereby limiting the maximum range of motion between the push rod piston 155 and the shell 11.

The material used to make push rod 154 may be selected to have a high thermal expansion coefficient to aid in its pushing function.

Due to the leak path through the hole 161 in the shell 11, the entire helical spring assembly is contained within a pressure chamber 151, which is attached to the shell 11 by means of a bolted, gasketed and flanged connection 160. Small holes (not shown) are provided in the push rod piston 155, compression piston 157 and screw stay 159 to allow pressure equalization between all internal volumes, thereby eliminating fluid pressure loads on the spring pistons.

Advantages of the Invention Include:

Tube support plate displacement system 150 has only one part, push rod 154, which is internal to the steam generator shell 11, thereby minimizing the potential of loose parts. Other than push rod 154, there are no parts within the shroud 26 where the tubes 27 are located. Other than push rod 154, all parts are external to the steam generator, and are contained within a separate pressure chamber 151. The hardware for implementing push rod forces is external to the steam generator, and is readily accessible for inspection, preload adjustment or stroke length adjustment.

The design is capable of being retrofitted to existing designs, since few internal alterations are required. Conversely, the tube support plate displacement system 150 can be easily removed, restoring the support arrangement to its original condition. The external pressure chamber 151 can accommodate alternate spring loading mechanisms.

The normal load paths used for the transmission of seismic loads between tubes 27, tube support plates 45, shroud 26, 33 and shell 11 are unaltered.

Push rod misalignment loads are reacted against the shell 11, which is a stiff anchor point, as opposed to a reaction against the shroud 26, which is relatively flexible.

The subject invention pushes the tube support plates 45 to achieve misalignment, which is preferable to pulling tube support plates 45, since there is no need for a structural attachment to the tube support plate 45.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

We claim:

1. A tube support system for use in a heat exchanger having a plurality of tubes in spaced parallel relation for flow of fluid there through for heat transfer with a fluid flowing there over, the heat exchanger further having a shroud, the shroud disposed within a pressure shell and surrounding the tubes, the tube support system comprising:

a tube support plate disposed transverse to the tubes, the support plate being made of a material having a lower coefficient of thermal expansion than the shroud; and means for displacing the tube support plate in a lateral direction transverse to the tubes.

2. The tube support system of claim 1, wherein the push rod is the only component of means for displacing the tube support plate located within the shroud.

3. The tube support system of claim 1, wherein the tube support plate comprises 410S stainless steel and the shroud comprises carbon steel.

4. The tube support system of claim 1, further comprising plural assemblies for displacing a tube support plate, each comprising a push rod engaged to a spring.

5. The tube support system of claim 1, further comprising:

a plurality of tube support plates disposed transverse to the tubes, the support plates being made of a material having a lower coefficient of thermal expansion than the shroud; and a plurality of assemblies for displacing a tube support plate in a lateral direction transverse to the tubes.

6. The tube support system of claim 1, further comprising:

a plurality of tube support plates disposed transverse to the tubes, the support plates being made of a material having a lower coefficient of thermal expansion than the shroud; and a plurality of assemblies for displacing a tube support plate in a lateral direction transverse to the tubes;

wherein, for at least one support plate, a plurality of assemblies for displacing a tube support plate are provided for a single support plate.

7. The tube support system of claim 1, wherein the system is part of a heat exchanger having a plurality of tubes in spaced parallel relation for flow of fluid there through for heat transfer with a fluid flowing there over, the heat exchanger further having a cylindrical shroud, the shroud disposed within a pressure shell and surrounding the tubes, and wherein the heat exchanger is connected to a conduit coming from a nuclear reactor for receiving heated primary coolant from the nuclear reactor for heat transfer.

8. The tube support system of claim 1, further comprising:

a plurality of alignment blocks located intermittently around an internal perimeter of the shroud, wherein said alignment blocks are also positioned intermittently around an outer perimeter of a tube support plate;

wherein, in a cold condition, the tube support plate is in contact with one or more alignment blocks around its perimeter, and said one or more alignment blocks control the lateral position of the tube support plate; and wherein, in a hot condition, the shroud is dilated relative to the tube support plate, and the tube support plate is laterally displaced with respect to its position in the cold condition by a push rod.

9. A tube support displacement system for use in a heat exchanger having a plurality of tubes in spaced parallel relation for flow of fluid there through for heat transfer with a fluid flowing there over, the heat exchanger further having tube support plates arranged transverse to the tubes, and a cylindrical shroud, the shroud disposed within a cylindrical pressure shell and surrounding the tubes, the tube support displacement system comprising:

a push rod having a first end for contacting a tube support plate and a second end opposite the first end in contact with a push rod piston;

a helical spring engaged with the push rod piston for applying a lateral displacement force to the push rod in a direction transverse to the tubes;

a pressure chamber external to the shell containing the helical spring and push rod piston; and means for attaching the pressure chamber to the external surface of the shell.

10. The tube support displacement system of claim 9, further comprising means, external to the shell, for adjusting the force applied to the push rod by the helical spring.

11. The tube support displacement system of claim 9, wherein the length of the push rod can be adjusted to limit the maximum lateral displacement of the push rod.

12. The tube support displacement system of claim 9, wherein the helical spring is preloaded.

13. The tube support displacement system of claim 9, the system further comprising:

a plurality of tube support plates disposed at different levels transverse to the tubes, the support plates being made of a material having a lower coefficient of thermal expansion than the shroud;

wherein each tube support plate is engaged by at least one corresponding means for displacing the tube support plate in a lateral direction transverse to the tubes; and wherein at least some of the tube support plates have different lateral alignments from other lateral support plates, and wherein those different lateral alignments are maintained including by push rods of their respective means for displacing the tube support plate.

14. The tube support displacement system of claim 9, wherein, in a cold condition, the tube support plate is in contact with one or more alignment blocks arranged on the shroud around its perimeter, and said one or more alignment blocks control the lateral position of the tube support plate; and wherein, in a hot condition, the shroud is dilated relative to the tube support plate, and the tube support plate is laterally displaced with respect to its position in the cold condition.

* * * * *